United States Patent [19]

Pabst

[11] Patent Number: 4,783,908

[45] **Date of Patent: * Nov. 15, 1988**

[54] INFRARED DRYING APPARATUS

[75] Inventor: Manfred Pabst, Cologne, Fed. Rep. of Germany

[73] Assignee: A. Monforts GmbH & Co., Fed. Rep. of Germany

[ * ] Notice: The portion of the term of this patent subsequent to Sep. 15, 2004 has been disclaimed.

[21] Appl. No.: 48,440

[22] Filed: May 11, 1987

[30] Foreign Application Priority Data

May 9, 1986 [DE] Fed. Rep. of Germany ..... 3615720

[51] Int. Cl.[4] ..... F26B 3/28

[52] U.S. Cl. ..... 34/4; 219/279

[58] Field of Search ..... 34/4, 48, 155; 432/59, 432/94, 222; 219/279

[56] References Cited

U.S. PATENT DOCUMENTS

| | | | |
|---|---|---|---|
| 3,157,390 | 11/1964 | Douglas | 219/279 |
| 3,230,947 | 1/1966 | Finnstrand | 219/279 |
| 3,409,460 | 11/1968 | Mitchell et al. | 34/4 |
| 3,618,914 | 11/1971 | Best | 34/152 |
| 4,693,013 | 9/1987 | Pabst et al. | 34/4 |

FOREIGN PATENT DOCUMENTS

| | | |
|---|---|---|
| 22900 | 12/1954 | Fed. Rep. of Germany . |
| 1460660 | 8/1969 | Fed. Rep. of Germany . |

*Primary Examiner*—Henry A. Bennet

*Attorney, Agent, or Firm*—Shefte, Pinckney & Sawyer

[57] ABSTRACT

An infrared heating apparatus for drying a traveling textile fabric web or the like wherein radiators having a first gas-heated radiator surface and a second electrically-heated radiator surface are pivotably mounted for selective alternating movement of the radiator surfaces into and out of heating relationship to the traveling fabric web. The apparatus enables the selective cost-efficient use of differing energy sources.

14 Claims, 2 Drawing Sheets

S
SWITCH MEANS
DRIVE MEANS
D
1
2
3
4
5
6
7
8
9
10
11
12
13
14
15
16

INFRARED DRYING APPARATUS

BACKGROUND OF THE INVENTION

The present invention relates generally to infrared drying apparatus and, more particularly, to such apparatus wherein a wall having a heating radiator is arranged along a textile fabric processing run for drying a traveling textile fabric.

Representative examples of conventional infrared drying apparatus of the aforementioned type are disclosed in published West German patent application S No. 22 990/82a, 34, and laid-open West German patent application DE-OS No. 14 60 660. The apparatus in the former application provides a swivel mounting for its radiators to permit movement between positions facing toward and away from the material to be treated and further provides a switching arrangement for deactivating the radiators when facing away from the traveling material, thereby to avoid possible damage to the traveling material as well as to adjacent components of the apparatus whenever the material travel is stopped. As will be understood, whenever the apparatus is restarted, the radiators must again be re-heated to their desired operating temperature and, to accommodate the required time for re-heating, the material web is accelerated to optimal traveling speed in relation to the heating of the radiators in order to achieve uniform drying treatment of the material. As will be understood, this necessity limits the overall production output and efficiency of the drying apparatus.

Another disadvantage of conventional infrared drying equipment lies in the manner by which the radiators are heated. Typically, the radiators of conventional drying apparatus are designed originally for heating either by electrical current or by combustible gas. Generally, purchasers of such drying equipment choose the means of heating which utilizes the energy source which is most economical overall within the area in which the apparatus is to be operated. However, the costs of the different forms of energy can vary considerably over the course of any given day, from day-to-day, and at differing times throughout the year, and may also vary from one country to the next. Accordingly, it is advantageous to have the capability of selectively heating an infrared drying apparatus with either gas or electricity, depending upon which form of energy is most cost-efficient at any given time. Unfortunately, to accomplish any such change with conventional drying equipment requires the replacement of either the entire machine or at least its basic heating components which, in turn, necessitates a considerable capital investment as well as considerable set-up labor and down time.

In contrast, the present invention provides an infrared drying apparatus capable of being selectively heated as desired by either gas or electricity and enabling the change between such energy types to be accomplished without ceasing or slowing operation of the machine.

SUMMARY OF THE INVENTION

Briefly summarized, the present infrared drying apparatus includes means defining a processing run along which a textile fabric web or the like to be treated may travel and a wall structure extending along at least a portion of the processing run. At least one radiator is movably mounted in association with the wall structure for movement with respect thereto. The radiator includes a first heated radiator surface and a second independently-heated radiator surface positioned for selective movement alternatively into and out of disposition at the wall structure in heating relation to the processing run of the traveling web.

Preferably, the wall structure defines a substantially vertical processing duct substantially about the processing run adapted for passage of the web therethrough in open width form. A ventilation arrangement is provided for drawing air through the duct. It is also preferred that a plurality of the radiators be arranged at spacings along the wall structure, with the first radiator surface of each radiator being arranged for heating by gas and the second radiator structure of each radiator being arranged for heating by electricity.

In the preferred embodiment, each radiator is arranged for movement rotatably about a radiator axis extending substantially parallel with respect to the wall structure. In one form of the present invention, the first and second radiator surfaces are located in substantially diametrical opposition to one another on the radiators for rotational movement of the radiators through substantially 180° to alternate the radiator surfaces, while in another form of the present invention, the radiator surfaces are located perpendicularly with respect to one another for 90° rotational movement of the radiators to alternate the radiator surfaces. Preferably, a second duct extends alongside the wall structure to enable the inactive radiator surface which is out of non-heating disposition at any given time to be disposed within the second duct. The ventilation arrangement is capable of drawing air through the first and second ducts, with a switching device being provided for selectively applying the ventilation arrangement to the first and second ducts. A drive arrangement is provided for actuating selective movement of the radiators and is preferably arranged in operative association with the switching arrangement so that the operation of each is controlled in relation to the other. It is also preferred that the drive arrangement be adapted for automatically moving the radiators upon any cessation of web movement in order to move the active radiator surface in heating disposition into a disposition out of heating relation to the processing run so as to avoid any danger of heat damage to the web. In this regard, each radiator may include a non-heating surface arranged to be selectively movable into disposition at the wall structure upon any such cessation of web movement. It is also preferred that the radiator surface which is out of heating relation with respect to the processing run at any given time be capable of activation in order to be preheated in advance of movement into heating relation to the run.

DESCRIPTION OF THE PREFERRED EMBODIMENT

Figure 1:
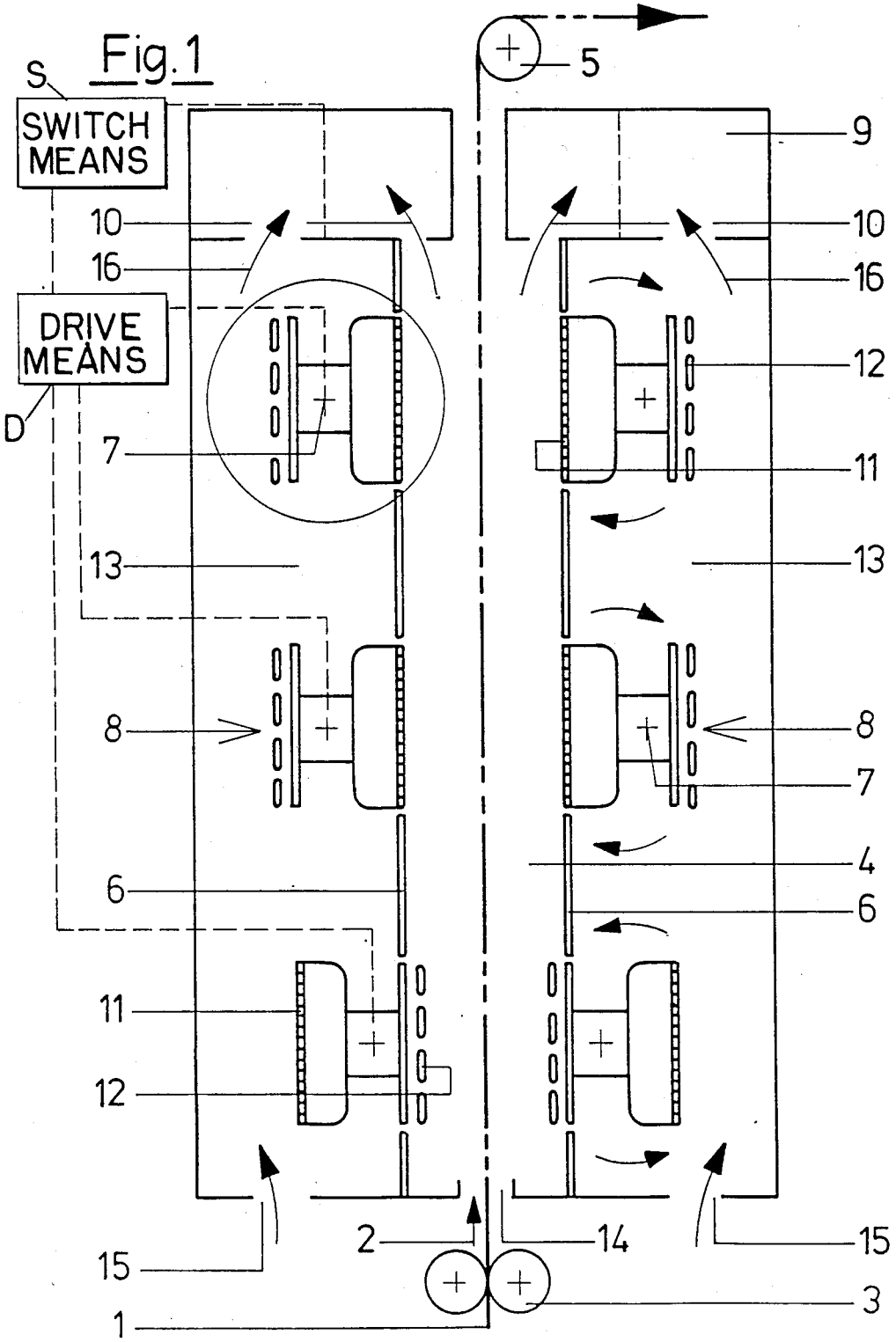
FIG. 1 is a schematic diagram of a vertical section through an infrared drying apparatus according to the preferred embodiment of the present invention.

Referring now to the accompanying drawings and initially to FIG. 1, an infrared drying apparatus is shown schematically in vertical section as preferably embodied for pre-drying a traveling textile fabric web 1 during its substantially vertical travel upwardly along a processing run as indicated by the arrow 2 between a pair of squeezer rolls 3 and a guide roller 5 from which the fabric web 1 is transported to subsequent processing stations.

The drying apparatus includes an upright housing structure having a pair of vertical interior heating walls 6 in facing parallel relation to one another to define a vertical processing duct or shaft 4 about the upward processing run 2 of the fabric web 1. Each heating wall 6 has a plurality of openings formed at spacings along its vertical extent at each of which openings is mounted a radiator structure, such as indicated generally at 8. According to the present invention, each radiator structure 8 is mounted rotatably about a radiator axis 7 extending substantially parallel in normal relation to the processing run 2 to permit reciprocal pivoting movement of each radiator 8 with respect to its respectively associated heating wall 6. It is a further feature of the present invention that each radiator 8 is provided with two independently heated radiator surfaces 11,12 arranged at arcuate spacings to one another with respect to the rotational radiator axis 7. By way of example, each radiator 8 shown in FIG. 1 is illustrated with its radiator surfaces 11,12 arranged in substantially diametrical opposition to one another at opposite sides of the radiator 8 whereby rotational movement of the radiator 8 through substantially 180° is required to alternate the radiator surfaces 11,12. Further, each radiator 8 in FIG. 1 has its radiator surface 11 arranged for heating by a combustible gas, e.g. natural gas, propane gas, or the like, and its radiator surface 12 arranged for heating electrically. Thus, the two radiator surfaces 11,12 of each radiator structure 8 may be selectively activated for heating by two alternate energy sources, e.g. gas and electricity, with the pivotable mounting of the radiator structures 8 on their respective radiator axes 7 enabling each radiator structure 8 to be selectively pivoted to alternately position either of the radiator surfaces 11,12 at the adjacent opening within the respectively associated heating wall 6 to face the processing run 2 of the fabric web 1 to be in heating relation thereto.

The drying apparatus of the present invention is also provided with a suction fan or the like representatively indicated at 9, at opposite sides of the web processing run 2 at the upward terminal end thereof to act as an air extractor for drawing ventilating air upwardly through the inlet opening 14 into and therefrom upwardly through the processing duct 4 as indicated by the directional arrows 10. According to a further feature of the present invention, the drying apparatus also includes an exterior housing outwardly about the radiator structures 8 and the interior heating walls 6 defining additional vertical ducts 13 outwardly alongside the interior heating walls 6 and the processing shaft 4 defined thereby. To enable ventilation of the outward ducts 13 as well, a switch device, such as representatively indicated by switch means S, is operatively associated with the suction fans 9 to enable them to be applied selectively to the outward ducts 13 (either alternatively with or in addition to application to the processing duct 4, as may be desired) in order to draw ventilating air upwardly through inlet openings 15 and therefrom through the outward ducts 13 as indicated by directional arrows 16. Alternatively, the outward ducts 13 may be provided as desired with their own respective suction fans. In either case, the capability of the present drying apparatus for ventilating the outward shafts 13 enables each radiator surface 11 or 12 positioned within the outward ducts 13 to be cooled down following an alternation of the radiator surfaces 11,12 or to be operated under full heating energy, such as for example for purposes of pre-heating the radiator surface 11 or 12 within the duct 13 in advance of pivoting alternation of the radiator surfaces 11,12, without in each case posing any risk of damage to or otherwise adversely affecting the structural and operational components of the drying apparatus.

Preferably, the drying apparatus is also provided with an appropriate drive arrangement, such as representatively indicated by drive means D, arranged in operative association with each radiator 8 for controlling the alternate selection of the radiator surfaces 11,12 to be positioned in heating disposition with respect to the web processing run. Desirably, the drive means D is further arranged to automatically pivot the radiators 8 upon any stoppage of the traveling movement of the textile web 1 to move the active heating radiator surface 11 or 12 from its heating disposition facing the web 1 into an inactive non-heating disposition within the respective outer duct 13. For this purpose, the drive means D in the embodiment of FIG. 1 is preferably adapted for pivoting the radiators 8 through a rotational turn of only 90° about the radiator axes 7 whereby both radiator surfaces 11,12 of each radiator 8 are disposed within the respective outward duct 13, thus eliminating the risk of excessively drying or possibly burning the fabric web 1. Moreover, this additionally enables the radiator surface 11 or 12 which is to be active upon re-starting of the web movement to be pre-heated or maintained at full heating power such as when the web stoppage is only temporary, as the case may be, while the radiator surface remains disposed within the outward shaft 13. As an additional feature of the present invention, the drive arrangement D may be operatively coupled with the switch arrangement S for the blower fans 9 to synchronize operation of the blower fans 9 with the pivotal operation of the radiators 8 to apply the suction ventilating force of the blower fans 9 to either or both the processing and outward ducts 4,13, in relation to the pivotal operation of the radiators 8. For example, as will be understood by those persons skilled in the art, it is advantageous to apply the blower fans 9 to the outward ducts 13 (instead of or in addition to application to the processing duct 4, as the case may be) following each pivotal alternation of the radiator surfaces 11,12 in order to ventilate the outward ducts 13 while the radiator surface 11,12 taken out of heating operation is cooled. Similarly, it is advantageous to apply the blower fans 9 to the outward ducts 13 whenever the radiator surfaces 11 or 12 disposed therewithin are energized, such as for purposes of pre-heating or during any temporary stoppage of the web travel.

Figure 2:
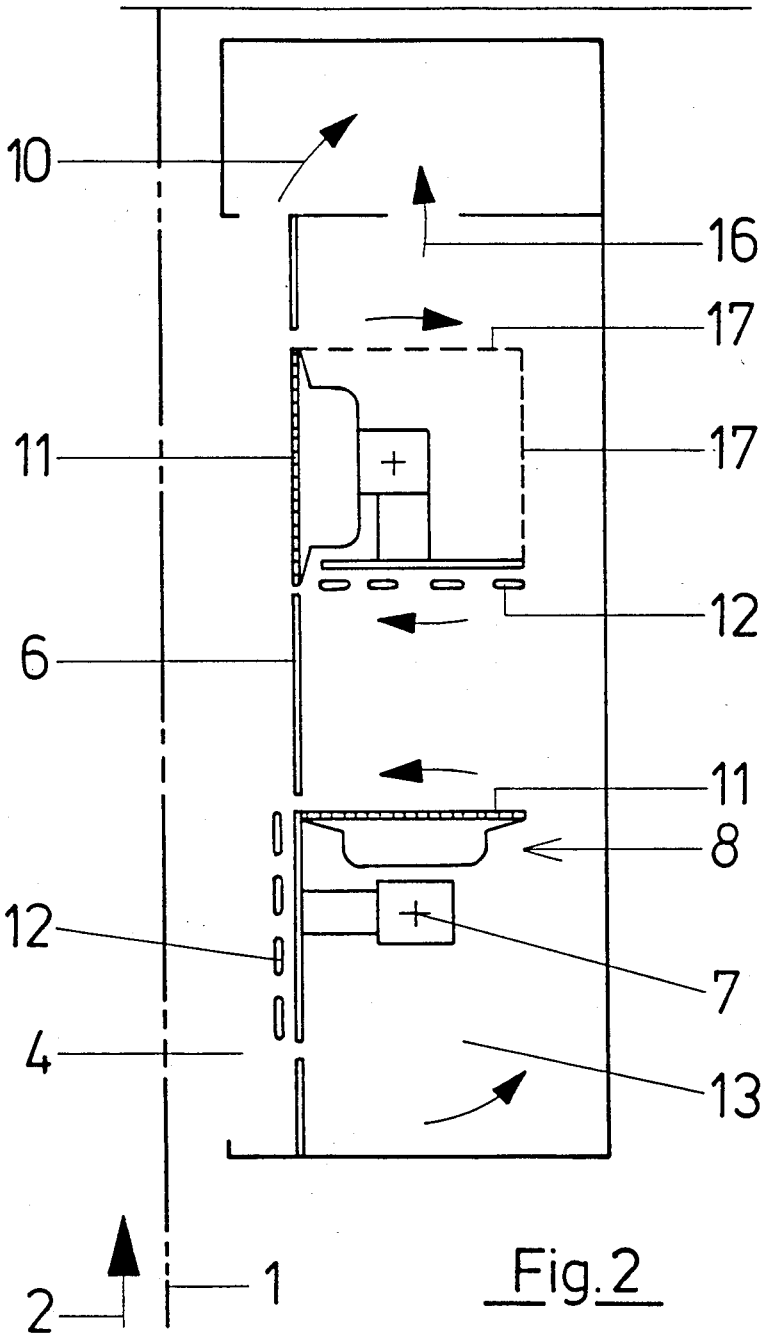
FIG. 2 is a similar schematic view showing a partial vertical section through an infrared dryer according to the preferred embodiment of the present invention, illustrating a differing form of radiator.

Referring now to FIG. 2 of the accompanying drawings, there is shown a partial section of a drying apparatus according to the present invention similar to that of FIG. 1, but equipped with an alternate embodiment of the radiators 8 wherein the gas and electric radiator surfaces 11,12 are located in substantially perpendicular relation to one another on the radiator structure 8 whereby rotational movement of the radiator structure 8 through only substantially 90° is required to alternate the radiator surfaces 11,12. In addition, the radiators 8 of the embodiment of FIG. 2 are provided with non-heating surfaces 17 which may be positioned upon rotational movement of the radiators 8 at the openings in the heating wall 6 when desired, such as during a stoppage in the traveling movement of the fabric web 1, to substantially close the openings in the heating wall 6 while the radiator surfaces 11,12 are both disposed within the outward duct 13.

The advantages of the present drying apparatus over conventional apparatus will thus be readily understood. Principally, the present apparatus provides the ready capability of alternating between two differing energy sources without the necessity of increased capital investments or complicated and time consuming machine modification. Thus, the present drying apparatus enables the user to achieve the most cost efficient utilization of available energy sources simply and easily without affecting the overall output and efficiency of a processing operation. In fact, alternation between energy sources may be accomplished with the present drying apparatus while the apparatus is in operation and without changing the traveling speed of the textile fabric web being processed, since the present apparatus provides the capability of pre-heating the radiator surface out of heating disposition in advance of movement into position in heating relation to the fabric web. Complimentarily, the present apparatus enables a radiator surface to be efficiently cooled following its movement out of heating operation. Further, the capability of the present apparatus for pre-heating an inactive radiator surface enables the apparatus to be started and re-started at full speed without the conventional necessity of gradually accelerating the speed of travel of the fabric web while the radiator is heated.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

That which is claimed is:

1. An infrared drying apparatus comprising means defining a processing run along which a textile fabric web or the like to be treated may travel, wall means extending along at least a portion of said run, and at least one radiator means movably mounted in association with said wall means for movement with respect thereto, said radiator means having a first heated radiator surface and a second independently-heated radiator surface positioned for selective movement alternately into and out of disposition at said wall means in heating relation to said run.

2. An infrared drying apparatus according to claim 1 and characterized further in that said wall means defines a processing duct substantially about said run adapted for passage of said web therethrough in open width form and ventilation means for drawing air through said duct.

3. An infrared drying apparatus according to claim 2 and characterized further in that said processing run extends in a substantially vertical direction.

4. An infrared drying apparatus according to claim 3 and characterized further by a plurality of said radiators arranged at spacings along said wall means.

5. An infrared drying apparatus according to claim 4 and characterized further in that said first heated radiator surface is arranged to be heated by gas and said second heated radiator surface is arranged to be heated electrically.

6. An infrared drying apparatus according to claim 1 and characterized further in that said radiator means is arranged for movement rotatably about a radiator axis extending substantially parallel with respect to said wall means.

7. An infrared drying apparatus according to claim 6 and characterized further in that said first and second radiator surfaces are located in substantially diametrical opposition to one another on said radiator means for rotational movement of said radiator means through substantially 180° to alternate said radiator surfaces.

8. An infrared drying apparatus according to claim 6 and characterized further in that said first and second radiator surfaces are located in substantially perpendicular relation to one another on said radiator means for rotational movement of said radiator means through substantially 90° to alternate said radiator surfaces.

9. An infrared drying apparatus according to claim 1 and characterized further by means defining a second duct extending alongside said wall means for disposition within said second duct of the inactive radiator surface which is out of run-heating disposition.

10. An infrared drying apparatus according to claim 9 and characterized further by ventilation means for drawing air through said first and second ducts and switching means for selectively applying said ventilation means to said first and second ducts.

11. An infrared drying apparatus according to claim 10 and characterized further by drive means for actuating selective movement of said radiator means, said drive means and said switching means being operatively associated for controlling operation of each in relation to the other.

12. An infrared drying apparatus according to claim 1 and characterized further by drive means for automatically moving said radiator means upon any cessation of web movement to move the active radiator surface in heating disposition into a disposition out of heating relation to said run to avoid any danger of heat damage to said web.

13. An infrared drying apparatus according to claim 12 and characterized further in that said radiator means includes a non-heating surface arranged to be selectively movable into disposition at said wall means upon any cessation of web movement.

14. An infrared drying apparatus according to claim 1 and characterized further by means for activating the radiator surface which is out of heating relation to said run for preheating in advance of movement into heating relation to said run.

* * * * *